US007671668B2

(12) United States Patent
Park

(10) Patent No.: US 7,671,668 B2
(45) Date of Patent: Mar. 2, 2010

(54) CORE VOLTAGE GENERATION CIRCUIT

(75) Inventor: Jae-Boum Park, Kyoungki-do (KR)

(73) Assignee: Hynix Semiconductor, Inc., Gyeonggi-do (KR)

( * ) Notice: Subject to any disclaimer, the term of this patent is extended or adjusted under 35 U.S.C. 154(b) by 73 days.

(21) Appl. No.: 12/164,275

(22) Filed: Jun. 30, 2008

(65) Prior Publication Data

US 2009/0058513 A1 Mar. 5, 2009

(30) Foreign Application Priority Data

Aug. 29, 2007 (KR) ..... 10-2007-0087230

(51) Int. Cl.
*G05F 1/10* (2006.01)

(52) U.S. Cl. ..... 327/540

(58) Field of Classification Search ..... 327/535, 327/538, 540, 541, 543
See application file for complete search history.

(56) References Cited

U.S. PATENT DOCUMENTS 6,157,176 A * 12/2000 Pulvirenti et al. ..... 323/266
6,184,744 B1 * 2/2001 Morishita ..... 327/541
6,522,111 B2 * 2/2003 Zadeh et al. ..... 323/277
6,753,721 B2 * 6/2004 Otsuka et al. ..... 327/540
7,417,494 B2 * 8/2008 Choi et al. ..... 327/541

FOREIGN PATENT DOCUMENTS

KR 102006003365 A 4/2006
KR 10-0721198 B1 5/2007

OTHER PUBLICATIONS

Notice of Preliminary Rejection issued from Korean Intellectual Property Office on Dec. 17, 2009.

* cited by examiner

*Primary Examiner*—Jeffrey S Zweizig
(74) *Attorney, Agent, or Firm*—IP & T Law Firm PLC

(57) ABSTRACT

A core voltage generation circuit includes a comparator configured to perform a differential comparison of a reference voltage and a feedback core voltage. An amplifier is configured to amplify the external power supply voltage in response to an output signal of the comparator to generate the core voltage. A control switch is configured to form a current path of the comparator using different switch units according to a voltage level of an external power supply voltage input to the core voltage generation circuit.

8 Claims, 3 Drawing Sheets

CORE VOLTAGE GENERATION CIRCUIT

CROSS-REFERENCE TO RELATED APPLICATION

The present invention claims priority of Korean patent application number 10-2007-0087230, filed on Aug. 29, 2007, which is incorporated by reference in its entirety.

BACKGROUND OF THE INVENTION

The present invention relates to a semiconductor memory device, and more particularly, to a core voltage generation circuit for generating core voltage.

A semiconductor memory device is used in storing data in a variety of applications. Such a semiconductor memory device is widely used in desktop computers, notebook computers and portable electronic apparatuses. Therefore, there is a need for the semiconductor memory device of large capacity, high speed, small size and low power.

In order to achieve the semiconductor memory device of low power, a method for minimizing power consumption in a core area of the memory device has been proposed. The core area includes a memory cell, a bit line and a word line, and is designed according to an ultra-fine design rule. To design an ultra-fine semiconductor memory device for performing high frequency operations, it is essential to lower power source voltage.

The semiconductor memory device uses an internal voltage of a voltage level adequate for operations in an internal circuit of the semiconductor memory device, which is generated by an external power supply voltage (VDD) lower than a certain voltage level. Specifically, a memory device, such as a dynamic random access memory (DRAM), which utilizes a bit line sense amplifier, uses a core voltage (VCORE) to sense cell data. When a word line is enabled, data in a plurality of memory cells connected to the word line are transferred to bit lines, and then the bit line sense amplifier sense and amplify voltage differences of bit line pairs. Generally, thousands of bit line sense amplifiers are operated at the same time. Thus, a large amount of current is consumed at a time at a core voltage terminal to drive pull-up power lines of the bit line sense amplifiers.

FIG. 1 is a circuit diagram of a conventional core voltage generation circuit.

Referring to FIG. 1, the conventional core voltage generation circuit includes a comparator 10, an amplifier 11 and a feedback voltage generator 12. The comparator 10 differentially compares a feedback voltage of half core voltage (½ voltage level of a potential at a core voltage terminal) and a reference voltage (VREFC) (of ½ voltage level of a target core voltage; 0.75 V). The amplifier 11 generates an amplified core voltage of approximately 1.5 V in response to an output signal of the comparator 10. The feedback voltage generator 12 divides the amplified core voltage, and outputs the feedback voltage having ½ voltage level of the potential at the core voltage terminal to monitor the core voltage. The conventional core voltage generation circuit further includes a control switch 13 configured to control operations of the comparator 10.

The core voltage generation circuit determines operation point of the comparator 10 using an external power supply voltage VDD applied to an NMOS transistor MN1 constituting the control switch 13.

As the NMOS transistor MN1 is turned on in response to the external power supply voltage VDD and the NMOS transistor MN2 is turned on in response to the reference voltage VREFC applied from the outside, drain voltages of the transistors MN1 and MN2 are lowered. That is, the potential of the node N1 is lowered. Then, a low level signal is applied to a gate of a PMOS transistor MP3 to turn on the PMOS transistor MP3, thereby increasing the core voltage VCORE output from the core voltage generation circuit.

As the core voltage VCORE is increased, the feedback voltage is also increased to thereby turn on an NMOS transistor MN3. As the NMOS transistor MN3 is turned on, a potential of the node N2 is decreased to decrease a voltage level applied to gates of the PMOS transistors MP1 and MP2. As a result of the decrease of the voltage level at the gates of the PMOS transistors MP1 and MP2, the PMOS transistors MP1 and MP2 are turned on, thereby increasing a potential of the node N1 gradually. That is, a gate voltage of the PMOS transistor MP3 is gradually increased. Such operations are repeated until the feedback voltage becomes equal to the reference voltage VREFC.

The conventional core voltage generation circuit determines an operation point of the comparator 10 using the external power supply voltage VDD applied to the gate of the NMOS transistor MN1 constituting the control switch 13. However, the external power supply voltage VDD inevitably has an error range within a certain range because it is applied from the outside.

Therefore, the turn on characteristic (current path) of the NMOS transistor MN1 is determined by the external power supply voltage VDD applied to the control switch 13. The turn on characteristic of the NMOS transistor MN1 affects the turn on characteristic of the NMOS transistor MN2 in the comparator 10, and thus the turn on characteristic of the PMOS transistor MP3 in the amplifier 11.

However, as described above, the conventional core voltage generation circuit determines the operation point of the comparator 10 only through the NMOS transistor MN1 regardless of the voltage level of the external power supply voltage VDD. Therefore, the conventional core voltage generation circuit has the limitation that the core voltage VCORE may become instable according to the external power supply voltage VDD.

SUMMARY OF THE INVENTION

Embodiments of the present invention are directed to providing a core voltage generation circuit that can generate a stable core voltage regardless of a voltage level of an external power supply voltage applied thereto.

In accordance with an aspect of the present invention, there is provided a comparator configured to perform a differential comparison of a reference voltage and a feedback core voltage, an amplifier configured to amplify the external power supply voltage in response to an output signal of the comparator to generate the core voltage and a control switch configured to form a current path of the comparator using different switch units according to a voltage level of an external power supply voltage input to the core voltage generation circuit.

DESCRIPTION OF SPECIFIC EMBODIMENTS

Hereinafter, a core voltage generation circuit in accordance with the present invention will be described in detail with reference to the accompanying drawings.

Figure 1:
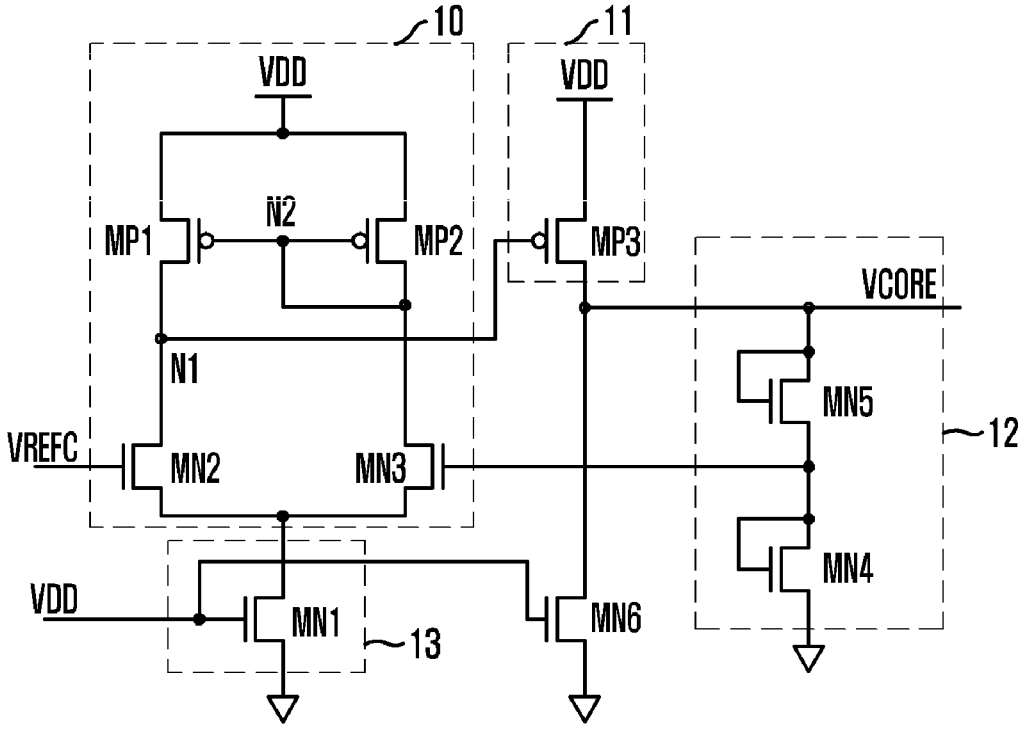
FIG. 1 (RELATED ART)
FIG. 1 is a circuit diagram of a conventional core voltage generation circuit.
Figure 2:
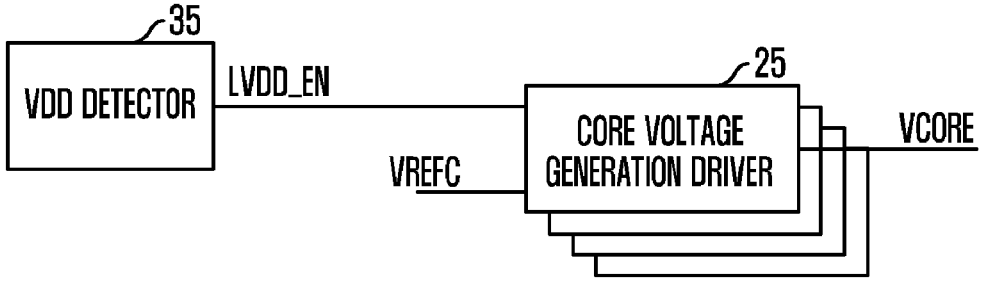
FIG. 2 is a block diagram of a core voltage generation circuit in accordance with an embodiment of the present invention.

FIG. 2 is a block diagram of a core voltage generation circuit in accordance with an embodiment of the present invention. Referring to FIG. 2, the core voltage generation circuit includes a VDD detector 35 and the core voltage generation driver 25. The VDD detector 35 detects a voltage level of an external power supply voltage VDD to generate a low external power supply voltage enable signal LVDD_EN according to the detection result. The core voltage generation driver 25 differentiates a current source determining an operation point of a comparator depending on the detected voltage level of the external power supply voltage VDD to generate a stable core voltage.

The VDD detector 35 compares a voltage level of a predetermined portion of the external power supply voltage VDD with a voltage level of a reference voltage VREF. If the voltage level of the predetermined portion of the external power supply voltage VDD is lower than the voltage level of the reference voltage VREF, the VDD detector 35 outputs the low external power supply voltage enable signal LVDD_EN of a high level. If the voltage level of the predetermined portion of the external power supply voltage VDD is higher than the voltage level of the reference voltage VREF, the VDD detector 35 outputs the low external power supply voltage LVDD_EN of a low level. Detailed description of configuration and operation of the VDD detector 35 will be given later with reference to FIG. 4.

In order to generate a stable core voltage, the core voltage generation driver 25 uses different current sources for determining the operation point of the comparator according to the logic level of the low external power supply voltage enable signal LVDD_EN.

Figure 3:
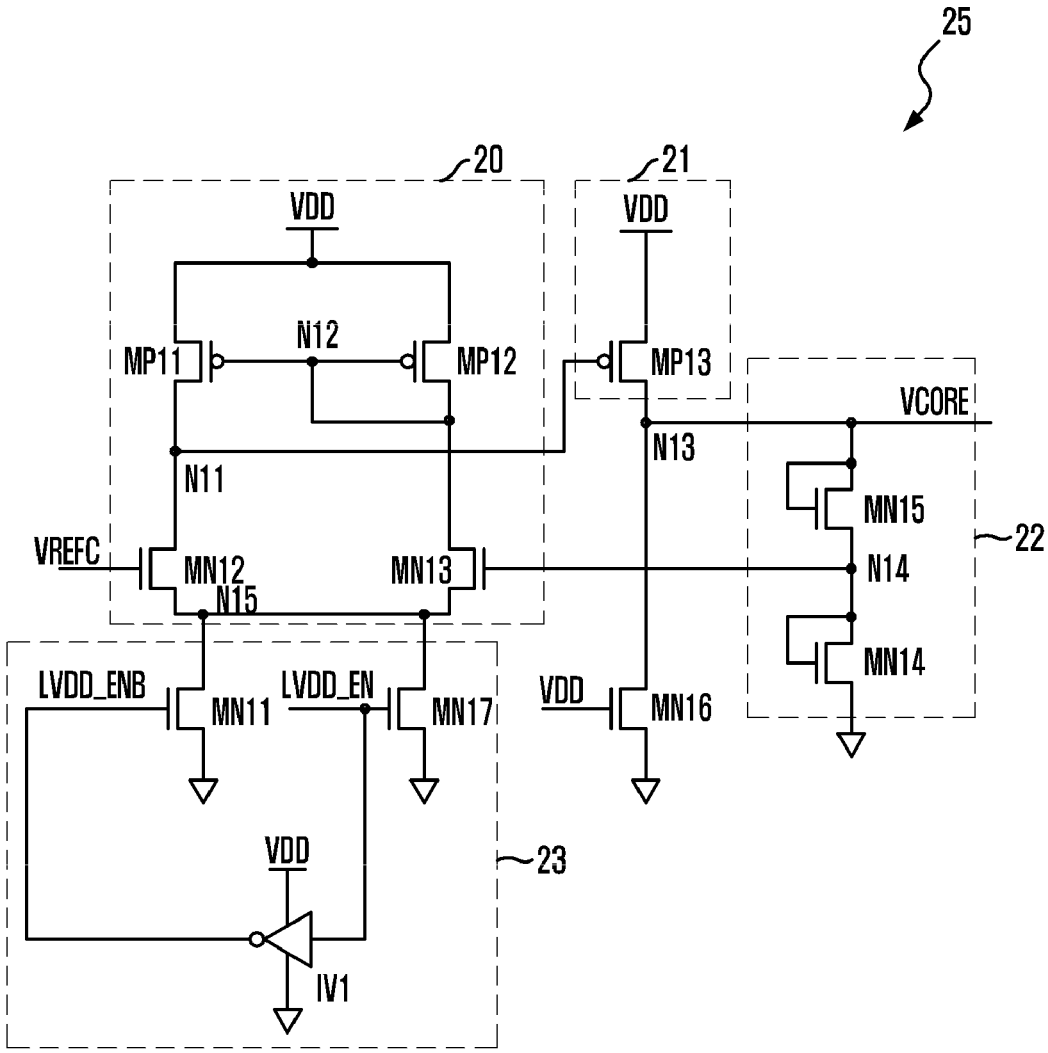
FIG. 3 is a circuit diagram of a core voltage generation driver of the core voltage generation circuit of FIG. 2.

Hereinafter, a method for generating a stable core voltage regardless of the voltage level of the external power supply voltage VDD will be described with reference to FIG. 3. Referring to FIG. 3, the core voltage generation driver 25 includes a comparator 20, an amplifier 21, a feedback voltage generator 22 and a control switch 23. The comparator 20 differentially compares a feedback voltage and a reference voltage VREFC. The feedback voltage may be a half core voltage having ½ voltage level of potential of the core voltage terminal. The reference voltage VREFC has ½ voltage level of a target core voltage (0.75V). The amplifier 21 amplifies a core voltage to approximately 1.5 V in response to an output signal of the comparator 20. The feedback voltage generator 22 divides the amplified core voltage to generate the feedback voltage having ½ voltage level of a potential of the core voltage terminal for monitoring the core voltage. The control switch 23 opens and closes current paths of the comparator 20 to enable and disable the comparator 20.

The comparator 20 includes two NMOS transistors MN12 and MN13 performing differential comparison in response to the reference voltage VREFC applied from the outside and the feedback voltage having ½ voltage level of the core voltage. Sources of the two transistors MN12 and MN13 are connected to each other through a node N15. The reference voltage VREFC is applied to a gate of the NMOS transistor MN12, and the feedback voltage is applied to a gate of the NMOS transistor MN13. A drain of the NMOS transistor MN12 is connected in series to the PMOS transistor MP11 through a node N11. The external power supply voltage VDD is applied to a source of the PMOS transistor MP11. A drain of the NMOS transistor MN13 is connected in series to a PMOS transistor MP12, and a gate and a drain of the PMOS transistor MP12 is connected to each other through a node N12. A gate of the PMOS transistor MP11 is also connected to the node N12. The external power supply voltage VDD is applied to a source of the PMOS transistor MP12.

The amplifier 21 includes a PMOS transistor MP13 having a gate connected to the node N11, a source receiving the external power supply voltage VDD, and a drain outputting an amplified core voltage VCORE. An NMOS transistor MN16 is connected in series between the PMOS transistor MP13 and a ground voltage.

The control switch 23 includes NMOS transistors MN17 and MN11, and an inverter IV1. The NMOS transistor MN17 has a drain connected to the node N15 included in the comparator 20, a gate configured to receive the low external power supply voltage enable signal LVDD_EN, and a source connected to the ground voltage. The NMOS transistor MN11 has a drain connected to the node N15, a gate configured to receive a low external power supply voltage disable signal LVDD_ENB, and a source connected to the ground voltage. The inverter IV1 inverts the low external power supply voltage enable signal LVDD_EN to output the low external power supply voltage disable signal LVDD_ENB.

The feedback voltage generator 22 includes NMOS transistors MN15 and MN14 connected in series to each other through a node N14. The NMOS transistors MN15 and MN14 are connected in series between an output terminal N13 for the core voltage generated by the amplifier 21 and the ground terminal. The node N14 is connected to the gate of the NMOS transistor MN13 included in the comparator 20. A drain and a gate of the NMOS transistor MN15 are connected to each other, which is the same to the NMOS transistor MN14. That is, the core voltage is divided by the two transistors MN14 and MN15. The divided core voltage is transferred to the gate of the NMOS transistor MN13 included in the comparator 20 to turn on the NMOS transistor MN13.

Hereinafter, an operation of the core voltage generation driver in accordance with the embodiment of the present invention will be described.

In order to operate the comparator 20, a current path should be formed by the control switch 23. The control switch 23 operates differently according to the voltage level of the external power supply voltage VDD, i.e., according to whether the external power supply voltage VDD is in the high level region or in the low level region. The external power supply voltage VDD in the low level region also has a voltage level sufficient to turn on the NMOS transistor, however, it has a relatively low voltage level in comparison with the external power supply voltage VDD in the high level region.

The NMOS transistors MN17 and MN11 included in the control switch 23 are selectively operated according to the voltage level of the external power supply voltage VDD. This will be described later in detail with reference to FIG. 4. When the voltage level of the predetermined portion of the external power supply voltage VDD is lower than the voltage level of the reference voltage, the low external power supply voltage enable signal LVDD_EN of a high level is applied to the control switch 23 to turn on the NMOS transistor MN17 and turn off the NMOS transistor MN11. Therefore, in this case, the NMOS transistor MN17 serves as the current source for determining the operation point of the comparator 20.

On the contrary, when the voltage level of the predetermined portion of the external power supply voltage VDD is higher than the voltage level of the reference voltage, the low external power supply voltage enable signal LVDD_EN of a low level is applied to the control switch 23. This signal turns off the NMOS transistor MN17 and is inverted by the inverter IV1 to turn on the NMOS transistor MN11. Therefore, in this case, the NMOS transistor MN11 serves as the current source for determining the operation point of the comparator 20.

The turn on characteristic of the NMOS transistor MN17 should be higher than that of the NMOS transistor MN11. This is because the NMOS transistor MN17 operates as the current source of the comparator 20 when the external power supply voltage VDD is in the low level region. That is, in order to generate a stable core voltage using the external power supply voltage VDD in the low level region, which has lower voltage level than the high level region, the turn on characteristic of the current source that determines the output characteristic of the comparator 20 should be increased accordingly.

As described above, when the applied external power supply voltage VDD is in the low level region, the low external power supply voltage enable signal LVDD_EN of a high level is applied to the control switch 23. This high level signal is applied to the gate of the NMOS transistor NM17. Then, the NMOS transistor MN17 is turned on to form the current path of the comparator 20. The low external power supply voltage enable signal LVDD_EN of a high level is inverted to a low level signal by the inverter IV1 and then applied to the NMOS transistor MN11 to turn it off.

As a result, the current path for operating the comparator 20 is formed by the turned on NMOS transistor MN17.

As the NMOS transistor MN12 is turned on by the reference voltage VREFC, the voltage level of the node N11 is lowered, and as the NMOS transistor MN17 is turned on, the voltage level of the node N15 is also lowered. The potential of the node N11 varies in connection with that of the node N15. That is, as the potential of the node N15 is lowered, the potential of the node N11 is also lowered accordingly.

The low level signal at the node N11 turns on the PMOS transistor MP13 constituting the amplifier 21 to apply an amplified core voltage to the node N13. Further, as the drain voltages of the NMOS transistor MN12 and MN17 are lowered, the turn on characteristic of the PMOS transistor MP13 is increased gradually, thereby increasing the voltage level of the output core voltage.

The turn on characteristic of the PMOS transistor MP13 varies in connection with the potential of the node N11. Resultantly, when the external power supply voltage VDD applied to the core voltage generation circuit is in the low level region, the turn on characteristic of the NMOS transistor MN17, which forms the current source, determines the potential of the node N15 and thus the potential of the node N11. Further, the potential of the node N11 determines the turn on characteristic of the PMOS transistor MP13 and thus the voltage level of the core voltage output through the node N13.

The feedback voltage for monitoring the core voltage is divided by the transistors MN15 and MN14 before being applied to the gate of the NMOS transistor MN13. The turning on of the NMOS transistor MN13 lowers the gate voltages of the PMOS transistors MP11 and MP12.

As the gate voltages of the transistors MP11 and MP12 are lowered, the transistors MP11 and MP12 are turned on, and thus the voltage level at the node N11 increases gradually. As a result, the gate voltage of the PMOS transistor MP13, which is turned on/off in response to the voltage of the node N11, is also increased gradually.

Since the transistor MP13 is a PMOS transistor, increase of the gate voltage decreases the turn on characteristic of the transistor MP13, thereby decreasing the output core voltage. As a result, the comparator 20 repeats the differential comparison until the feedback voltage for monitoring the core voltage becomes equal to the reference voltage VREFC.

Next, when the applied external power supply voltage VDD is in the high level region, the low external power supply voltage enable signal LVDD_EN of a low level is applied to the control switch 23. This low level signal is inverted to a high level signal by the inverter IV1 and then applied to the gate of the NMOS transistor NM11. Then, the NMOS transistor MN11 is turned on to form the current path of the comparator 20. The low external power supply voltage enable signal LVDD_EN of a low level is also applied to the NMOS transistor MN17 to turn it off.

As a result, the current path for operating the comparator 20 is formed by the turned on NMOS transistor MN11.

As the NMOS transistor MN12 is turned on by the reference voltage VREFC, the voltage level of the node N11 is lowered, and as the NMOS transistor MN11 is turned on, the voltage level of the node N15 is also lowered. The potential of the node N11 varies in connection with that of the node N15. That is, as the potential of the node N15 is lowered, the potential of the node N11 is also lowered accordingly. Here, the potential of the node N15 and that of the node N11 are relatively high in comparison with the above described case where the applied external power supply voltage VDD is in the low level region.

The low level signal at the node N11 turns on the PMOS transistor MP13 constituting the amplifier 21 to apply an amplified core voltage to the node N13. Further, as the drain voltages of the NMOS transistor MN12 and MN11 are lowered, the turn on characteristic of the PMOS transistor MP13 is increased gradually, thereby increasing the voltage level of the output core voltage.

The turn on characteristic of the PMOS transistor MP13 varies in connection with the potential of the node N11. Resultantly, when the external power supply voltage VDD applied to the core voltage generation circuit is in the high level region, the turn on characteristic of the NMOS transistor MN11, which forms the current source, determines the potential of the node N15 and thus the potential of the node N11. Further, the potential of the node N11 determines the turn on characteristic of the PMOS transistor MP13 and thus the voltage level of the core voltage output through the node N13.

The feedback voltage for monitoring the core voltage is divided by the transistors MN15 and MN14 before being applied to the gate of the NMOS transistor MN13. The turning on of the NMOS transistor MN13 lowers the gate voltages of the PMOS transistors MP11 and MP12.

As the gate voltages of the transistors MP11 and MP12 are lowered, the transistors MP11 and MP12 are turned on, and thus the voltage level at the node N11 is increased gradually. As a result, the gate voltage of the PMOS transistor MP13, which is turned on/off in response to the voltage of the node N11, is also increased gradually.

Since the transistor MP13 is a PMOS transistor, increase of the gate voltage decreases the turn on characteristic of the transistor MP13, thereby decreasing the output core voltage. As a result, the comparator 20 repeats the differential comparison until the feedback voltage for monitoring the core voltage becomes equal to the reference voltage VREFC.

As described above, the core voltage generation driver generates the low external power supply voltage enable signal LVDD_EN, and the logic level of the low external power supply voltage enable signal LVDD_EN is determined depending on the voltage level of the external power supply voltage VDD received from the outside. Then, the core voltage generation driver operates the comparator 20 differently according to whether the external power supply voltage VDD is in the high level region or in the low level region. To this end, the core voltage generation driver determines the operation point of the comparator using the current sources having different turn on characteristics. As such, the core voltage generation driver can generate a stable core voltage regardless of the voltage level of the external power supply voltage VDD.

Figure 4:
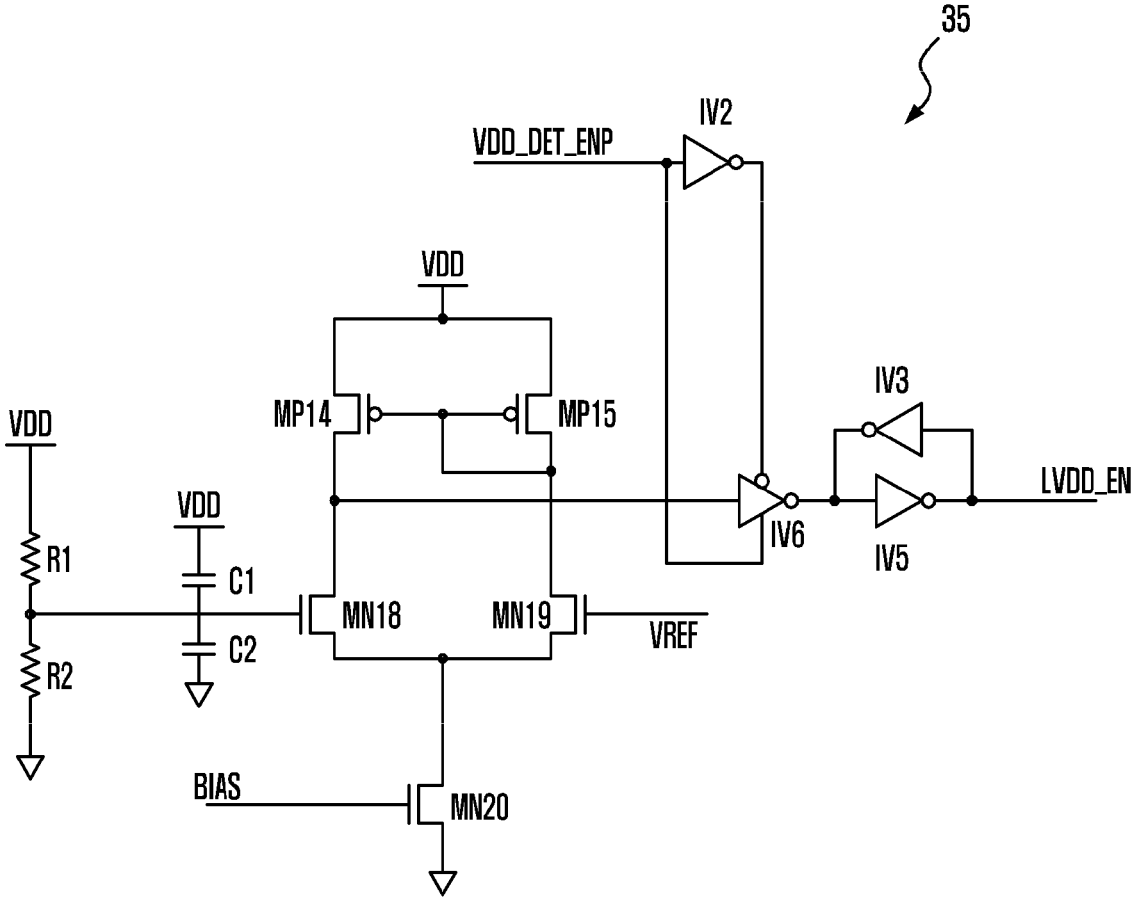
FIG. 4 is a circuit diagram of a VDD detector of the core voltage generation circuit of FIG. 2.

Hereinafter, the VDD detector of the core voltage generation circuit of FIG. 2 will be described with reference to FIG. 4.

The VDD detector includes a voltage divider, a comparator, a switch, inverters IV6, IV5 and IV3 and an inverter IV2. The voltage divider includes resistors R1 and R2 and capacitors C1 and C2 to divide the external power supply voltage VDD. The comparator includes NMOS transistors MN18 and MN19 and PMOS transistors MP14 and MP15 to differentially compare the divided external power supply voltage received from the voltage divider and the reference voltage VREF. The switch includes an NMOS transistor MN20 for forming a current path for the comparator. The inverters IV6, IV5 and IV3 invert the comparison results. The inverter IV2 receives a pulse signal VDD_DET_ENP generated after the external power supply voltage is stabilized. The reference voltage VREF is predetermined to detect the voltage level of the external power supply voltage VDD.

In the VDD detector, the voltage level of the external power supply voltage VDD is divided before being compared with the voltage level of the reference voltage VREF. That is, when the voltage level of the divided external power supply voltage is higher than the voltage level of the reference voltage VREF, the NMOS transistor MN18 is turned on so that the inverter IV6 outputs a high level signal. The high level signal is inverted by the inverter IV5 to a low level signal.

That is, when the voltage level of the divided external power supply voltage is higher than the voltage level of the reference voltage VREF, the external power supply voltage VDD is considered to be in a high level region. Then, the VDD detector outputs a low external power supply voltage enable signal LVDD_EN of a low level.

On the contrary, when the voltage level of the divided external power supply voltage is lower than the voltage level of the reference voltage VREF, the NMOS transistor MN19 is turned on so that the inverter IN6 outputs a low level signal. This low level signal is inverted by the inverter IV5 to a high level signal.

That is, when the voltage level of the divided external power supply voltage is lower than the voltage level of the reference voltage VREF, the external power supply voltage VDD is considered to be in a low level region. Then, the VDD detector outputs a low external power supply voltage enable signal LVDD_EN of a high level.

As described above, the core voltage generation driver generates the low external power supply voltage enable signal LVDD_EN, and a logic level of the low external power supply voltage enable signal LVDD_EN is determined depending on the voltage level of the external power supply voltage VDD received from the outside. Then, the core voltage generation driver operates the comparator 20 differently according to whether the external power supply voltage VDD is in the high level region or in the low level region. To this end, the core voltage generation driver determines the operation point of the comparator using the current sources having different turn on characteristics. As such, the core voltage generation driver can generate a stable core voltage regardless of the voltage level of the external power supply voltage VDD While the present invention has been described with respect to the specific embodiments, it will be apparent to those skilled in the art that various changes and modifications may be made without departing from the spirit and scope of the invention as defined in the following claims.

For example, although it has been described that the voltage level of the predetermined portion of the external power supply voltage VDD is compared with the reference voltage to determine whether the external power supply voltage is in the high level region or in the low level region, the present invention is not limited thereto. That is, the possible range of the voltage level of the external power supply voltage VDD may also be divided into more number of regions with finer voltage ranges, and thus the core voltage generation driver may also be provided with more number of compensators.

What is claimed is:

1. A core voltage generation circuit, comprising:

a comparator configured to perform a differential comparison of a reference voltage and a feedback core voltage;

an amplifier configured to amplify the external power supply voltage in response to an output signal of the comparator to generate the core voltage; and a control switch configured to form a current path of the comparator using different switch units according to a voltage level of an external power supply voltage input to the core voltage generation circuit.

2. The core voltage generation circuit as recited in claim 1, wherein the control switch includes a first switch unit turned on when the external power supply voltage is in a low level region, and a second switch unit turned on when the external power supply voltage is in a high level region.

3. The core voltage generation circuit as recited in claim 2, wherein the control switch further includes an inverter configured to invert a control signal applied to the control switch when the external power supply voltage is in the low level region to turn off the second switch unit.

4. The core voltage generation circuit as recited in claim 3, wherein the first and second switch units each include an NMOS transistor.

5. The core voltage generation circuit as recited in claim 4, wherein the first switch unit has a relatively high turn on characteristic in comparison with the second switch unit.

6. The core voltage generation circuit as recited in claim 1, further comprising a feedback voltage generator connected between an output terminal of the amplifier and a ground voltage to generate the feedback voltage for monitoring the core voltage.

7. The core voltage generation circuit as recited in claim 1, further comprising a detector configured to compare a voltage level of a predetermined portion of the external power supply voltage with a voltage level of a second reference voltage to output to the control switch a high level signal when the voltage level of the predetermined portion of the external power supply voltage is lower than the voltage level of the second reference voltage and a low level signal when the voltage level of the predetermined portion of the external power supply voltage is higher than the voltage level of the second reference voltage.

8. The core voltage generation circuit as recited in claim 7, wherein the detector include:

a voltage divider configured to divide the external power supply voltage;

a comparator configured to compare the divided external power supply voltage received from the voltage divider and the second reference voltage; and a switch configured to form a current path for the comparator.

* * * * *